US011622661B2

(12) United States Patent
Jang et al.

(10) Patent No.: US 11,622,661 B2
(45) Date of Patent: Apr. 11, 2023

(54) ROBOT CLEANER

(71) Applicant: LG ELECTRONICS INC., Seoul (KR)

(72) Inventors: Jaewon Jang, Seoul (KR); Minwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 208 days.

(21) Appl. No.: 17/207,371

(22) Filed: Mar. 19, 2021

(65) Prior Publication Data

US 2021/0204783 A1 Jul. 8, 2021

Related U.S. Application Data

(63) Continuation of application No. 16/057,492, filed on Aug. 7, 2018, now Pat. No. 10,986,973.

(30) Foreign Application Priority Data

Aug. 7, 2017 (KR) ..... 10-2017-0099758

(51) Int. Cl.
*A47L 11/282* (2006.01)
*A47L 11/40* (2006.01)
(Continued)

(52) U.S. Cl.
CPC ..... *A47L 11/282* (2013.01); *A47L 11/24* (2013.01); *A47L 11/283* (2013.01);
(Continued)

(58) Field of Classification Search
CPC ..... A47L 11/282; A47L 11/24; A47L 11/283; A47L 11/4013; A47L 11/4025;
(Continued)

(56) References Cited

U.S. PATENT DOCUMENTS 2,988,762 A 6/1961 Babcock
5,421,053 A 6/1995 Chodak
(Continued)

FOREIGN PATENT DOCUMENTS

CN 1320409 11/2001
CN 1575724 2/2005
(Continued)

OTHER PUBLICATIONS

Chinese Office Action (with English translation) dated Dec. 28, 2020 issued in CN Application No. 201880065371.4.
(Continued)

*Primary Examiner* — David Redding
(74) *Attorney, Agent, or Firm* — Ked & Associates, LLP

(57) ABSTRACT

A robot cleaner includes a main body which forms an external shape; two or more spin mops which rotate in a clockwise or counterclockwise direction when viewed from above and mop a floor with a damp cloth, and move the main body; and a cleaning module which is positioned in front of the spin mops and collects foreign substance existing on a cleaning target surface, wherein the cleaning module includes: a housing which is coupled to the main body and opened at a lower side; a dust container which forms a space for accommodating foreign substance and is positioned to be detachable in a lower side direction of the housing; and an agitator which is positioned inside the housing, and sends foreign substance existing on the cleaning target surface to the dust container by a rotation operation.

15 Claims, 18 Drawing Sheets

(51) Int. Cl.
*A47L 11/24* (2006.01)
*A47L 11/283* (2006.01)

(52) U.S. Cl.
CPC ..... *A47L 11/4013* (2013.01); *A47L 11/4025* (2013.01); *A47L 11/4041* (2013.01); *A47L 11/4069* (2013.01); *A47L 11/4083* (2013.01); *A47L 2201/00* (2013.01)

(58) Field of Classification Search
CPC ..... A47L 11/4041; A47L 11/4069; A47L 11/4083; A47L 2201/00; A47L 11/4038; A47L 11/408
See application file for complete search history.

(56) References Cited

U.S. PATENT DOCUMENTS

| | | | |
|---|---|---|---|
| 5,716,730 | A | 2/1998 | Deguchi |
| 5,998,953 | A | 12/1999 | Nakamura et al. |
| 6,012,618 | A | 1/2000 | Matsuo |
| 8,898,844 | B1 | 12/2014 | Dooley et al. |
| 10,952,586 | B2 | 3/2021 | Jang |
| 11,197,595 | B2 | 12/2021 | Jang et al. |
| 2004/0143927 | A1 | 7/2004 | Haegermarck et al. |
| 2004/0181896 | A1 | 9/2004 | Egawa et al. |
| 2005/0015913 | A1 | 1/2005 | Kim et al. |
| 2005/0166356 | A1 | 8/2005 | Uehigashi |
| 2006/0185690 | A1 | 8/2006 | Song et al. |
| 2007/0051757 | A1 | 3/2007 | Lim et al. |
| 2007/0061040 | A1 | 3/2007 | Augenbraun et al. |
| 2008/0276407 | A1 | 11/2008 | Schnittman et al. |
| 2009/0064447 | A1 | 3/2009 | Oh et al. |
| 2009/0281661 | A1 | 11/2009 | Dooley et al. |
| 2010/0251497 | A1 | 10/2010 | Arnold |
| 2011/0202175 | A1 | 8/2011 | Romanov et al. |
| 2012/0079670 | A1 | 4/2012 | Yoon et al. |
| 2012/0168971 | A1 | 7/2012 | Hansen et al. |
| 2012/0169497 | A1 | 7/2012 | Schnittman et al. |
| 2012/0222706 | A1 | 9/2012 | Pears et al. |
| 2014/0196247 | A1 | 7/2014 | Kasper |
| 2014/0259478 | A1 | 9/2014 | Conrad |
| 2015/0026920 | A1 | 1/2015 | Hsu |
| 2015/0143646 | A1 | 5/2015 | Jeong et al. |
| 2015/0182090 | A1 | 7/2015 | Park et al. |
| 2015/0223653 | A1 | 8/2015 | Kim et al. |
| 2016/0095487 | A1 | 4/2016 | Koura et al. |
| 2016/0150934 | A1 | 6/2016 | Kim et al. |
| 2016/0214260 | A1 | 7/2016 | Lee et al. |
| 2016/0331112 | A1 | 11/2016 | Goff |
| 2016/0353960 | A1 | 12/2016 | Dooley et al. |
| 2017/0071435 | A1 | 3/2017 | Jeong |
| 2017/0143175 | A1 | 5/2017 | Kim et al. |
| 2017/0147000 | A1 | 5/2017 | Hoennige et al. |
| 2017/0181591 | A1 | 6/2017 | Tanaka et al. |
| 2017/0296021 | A1 | 10/2017 | Li et al. |
| 2018/0242810 | A1 | 8/2018 | Jang et al. |
| 2019/0191952 | A1 | 6/2019 | Johnson et al. |
| 2019/0290089 | A1 | 9/2019 | Johnson et al. |

FOREIGN PATENT DOCUMENTS

| | | |
|---|---|---|
| CN | 1823677 | 8/2006 |
| CN | 102292973 | 12/2011 |
| CN | 102440718 | 5/2012 |
| CN | 102481080 | 5/2012 |
| CN | 202505272 | 10/2012 |
| CN | 202681849 | 1/2013 |
| CN | 103899160 | 7/2014 |
| CN | 104068799 | 10/2014 |
| CN | 204581160 | 8/2015 |
| CN | 104918529 | 9/2015 |
| CN | 105873486 | 8/2016 |
| CN | 106102537 | 11/2016 |
| CN | 106510556 | 3/2017 |
| CN | 106725135 | 5/2017 |
| EP | 1 695 652 | 8/2006 |
| EP | 1 762 165 | 3/2007 |
| EP | 2 327 347 | 6/2011 |
| EP | 2 438 8483 | 4/2012 |
| EP | 2 875 768 | 5/2015 |
| EP | 3 138 459 | 3/2017 |
| JP | S45-013591 | 6/1970 |
| JP | S49-65061 | 6/1974 |
| JP | S57-037431 | 3/1982 |
| JP | S63-168142 | 7/1988 |
| JP | S63-200731 | 8/1988 |
| JP | H07-009245 | 2/1995 |
| JP | H09-017404 | 1/1997 |
| JP | H09-324875 | 12/1997 |
| JP | H10-211132 | 8/1998 |
| JP | H10-243066 | 9/1998 |
| JP | 2001-249734 | 9/2001 |
| JP | 2002-065538 | 3/2002 |
| JP | 2003-320322 | 11/2003 |
| JP | 2004-166968 | 6/2004 |
| JP | 2005-040578 | 2/2005 |
| JP | 2005-211368 | 8/2005 |
| JP | 2005-211426 | 8/2005 |
| JP | 2005-312702 | 11/2005 |
| JP | 2006-231028 | 9/2006 |
| JP | 2009-509220 | 3/2009 |
| JP | 4278591 | 6/2009 |
| JP | 2009-178345 | 8/2009 |
| JP | 2014-014455 | 1/2014 |
| JP | 2014-137694 | 7/2014 |
| JP | 2015-163153 | 9/2015 |
| KR | 20-1988-0011603 | 8/1988 |
| KR | 10-0241620 | 4/2000 |
| KR | 10-2005-0012047 | 1/2005 |
| KR | 20-0395016 | 9/2005 |
| KR | 10-0661339 | 12/2006 |
| KR | 10-2007-0101432 | 10/2007 |
| KR | 20-0437646 | 12/2007 |
| KR | 10-0814507 | 3/2008 |
| KR | 10-2008-0040761 | 5/2008 |
| KR | 10-0835968 | 6/2008 |
| KR | 10-0848568 | 7/2008 |
| KR | 10-2008-0081626 | 9/2008 |
| KR | 10-2008-0089966 | 10/2008 |
| KR | 10-0871114 | 11/2008 |
| KR | 10-2010-0076134 | 7/2010 |
| KR | 10-1026003 | 3/2011 |
| KR | 20-0458863 | 3/2012 |
| KR | 10-2012-0069845 | 6/2012 |
| KR | 10-1152720 | 6/2012 |
| KR | 10-1164291 | 7/2012 |
| KR | 10-2012-0129185 | 11/2012 |
| KR | 10-1323597 | 11/2013 |
| KR | 10-1338143 | 12/2013 |
| KR | 10-2014-0011216 | 1/2014 |
| KR | 10-1369220 | 3/2014 |
| KR | 10-2014-0060450 | 5/2014 |
| KR | 10-2014-0089556 | 7/2014 |
| KR | 10-1487778 | 1/2015 |
| KR | 10-2015-0014351 | 2/2015 |
| KR | 10-1495866 | 2/2015 |
| KR | 10-2015-0057959 | 5/2015 |
| KR | 10-1519685 | 5/2015 |
| KR | 10-2015-0073726 | 7/2015 |
| KR | 10-2015-0078094 | 7/2015 |
| KR | 10-2015-0095469 | 8/2015 |
| KR | 10-1543490 | 8/2015 |
| KR | 10-1544667 | 8/2015 |
| KR | 10-2015-0107398 | 9/2015 |
| KR | 10-2015-0139111 | 12/2015 |
| KR | 10-1578879 | 12/2015 |
| KR | 10-2016-0003435 | 1/2016 |
| KR | 10-1602790 | 3/2016 |
| KR | 10-1622740 | 5/2016 |
| KR | 10-2016-0090567 | 8/2016 |
| KR | 10-2016-0090571 | 8/2016 |
| KR | 10-2016-0097085 | 8/2016 |
| KR | 10-1654014 | 9/2016 |
| KR | 10-1678443 | 12/2016 |

(56) References Cited

FOREIGN PATENT DOCUMENTS

| | | |
|---|---|---|
| KR | 10-2017-0035823 | 3/2017 |
| KR | 10-2017-0049532 | 5/2017 |
| KR | 10-2017-0124216 | 11/2017 |
| KR | 10-2018-0008250 | 1/2018 |
| KR | 10-2018-0025795 | 3/2018 |
| WO | WO 2005/011461 | 2/2005 |
| WO | WO 2009/132317 | 10/2009 |
| WO | WO 2015/186944 | 12/2015 |
| WO | WO 2016/036183 | 3/2016 |
| WO | WO 2017/191928 | 11/2017 |

OTHER PUBLICATIONS

Chinese Office Action (with English translation) dated May 11, 2021 issued in CN Application No. 201980021890.5.
Japanese Office Action dated Mar. 2, 2021 issued in JP Application No. 2020-507006.
European Search Report dated Mar. 29, 2021 issued in EP Application No. 18844052.3.
U.S. Office Action dated Oct. 5, 2021 issued in U.S. Appl. No. 16/057,076.
Japanese Office Action dated Mar. 2, 2021 issued in JP Application No. 2020-506998.
Chinese Office Action (with English translation) dated Mar. 9, 2021 issued in CN Application No. 201880065253.3.
Japanese Office Action dated Mar. 23, 2021 issued in JP Application No. 2020-507000.
European Search Report dated Mar. 26, 2021 issued in EP Application No. 18842946.8.
Chinese Office Action dated Dec. 24, 2020 issued in CN Application No. 201880065199.2.
Chinese Office Action dated Aug. 12, 2021 issued in CN Application No. 201880065199.2.
European Search Report dated Apr. 12, 2021 issued in EP Application No. 18844056.4.
United States Office Action dated Mar. 18, 2022 issued in co-pending related U.S. Appl. No. 16/057,076.
European Search Report dated Apr. 6, 2021 issued in EP Application No. 18843150.6.
European Search Report dated Nov. 14, 2018 issued in EP Application No. 18187619.4.
European Search Report dated Nov. 14, 2018 issued in EP Application No. 18187630.1.
European Search Report dated Nov. 16, 2018 issued in EP Application No. 18187634.3.
Korean Office Action dated Nov. 20, 2018 issued in KR Application No. 10-2017-0099752.
Korean Office Action dated Nov. 20, 2018 issued in KR Application No. 10-2017-0099754.
Korean Office Action dated Nov. 21, 2018 issued in KR Application No. 10-2017-0099755.
Korean Office Action dated Nov. 21, 2018 issued in KR Application No. 10-2017-0099756.
Korean Office Action dated Nov. 21, 2018 issued in KR Application No. 10-2017-0099757.
Korean Office Action dated Nov. 29, 2018 issued in KR Application No. 10-2017-0099758.
International Search Report dated Dec. 4, 2018 issued in PCT/KR2018/008928.
International Search Report dated Dec. 7, 2018 issued in PCT/KR2018/008922.
International Search Report dated Dec. 10, 2018 issued in PCT/KR2018/008954 (English translation).
Korean Office Action dated Jan. 22, 2019 issued in KR Application No. 10-2017-0099763.
Korean Office Action dated Jan. 31, 2019 issued in Application No. 10-2018-0009437.
International Search Report dated May 22, 2019 issued in PCT/KR2019/001021.
Korean Notice of Allowance dated May 22, 2019 issued in KR Application No. 10-2017-0099753.
Korean Office Action dated Oct. 29, 2019 issued in KR Application No. 10-2019-0124685.
Korean Office Action dated Apr. 22, 2020 issued in KR Application No. 10-2019-0124685.
United States Office Action dated Apr. 24, 2020 issued in U.S. Appl. No. 16/057,492.
United States Notice of Allowance dated May 11, 2020 issued in U.S. Appl. No. 16/057,572.
United States Office Action dated Jun. 17, 2020 issued in co-pending related U.S. Appl. No. 16/057,550.
United States Office Action dated Oct. 21, 2020 issued in U.S. Appl. No. 16/057,076.
United States Office Action dated Nov. 19, 2020 issued in U.S. Appl. No. 16/057,448.
Chinese Office Action (with English translation) dated Dec. 21, 2020 issued in CN Application No. 201880065247.8.
Japanese Office Action dated Feb. 2, 2021 issued in JP Application No. 2020-506999.
United States Office Action dated Feb. 9, 2021 issued in U.S. Appl. No. 16/057,516.
European Search Report dated Apr. 9, 2021 issued in EP Application No. 18843690.1.
U.S. Office Action dated Nov. 28, 2022 issued in U.S. Appl. No. 17/180,495.

ROBOT CLEANER

CROSS-REFERENCE TO RELATED APPLICATIONS

This application is a Continuation of U.S. application Ser. No. 16/057,492, filed Aug. 7, 2018, which claims priority under 35 U.S.C. § 119 to Korean Application No. 10-2017-0099758 filed on Aug. 7, 2017, whose entire disclosures are hereby incorporated by reference.

BACKGROUND

1. Field

The present application relates to a robot cleaner, and more particularly, to a robot cleaner having a cleaning module to sweep foreign objects on a surface to be cleaned.

2. Background

The use of robots in the home has been gradually expanding. An example of such a household robot is a robot cleaner (also referred to as an autonomous cleaner). The robot cleaner is a mobile robot that travels autonomously within a region and can perform cleaning while travelling. For example, the robot cleaner may suction foreign substance such as dust on a floor, or may mop the floor using a rotation mop. Additionally, the robot cleaner having the rotation mop may travel based on the movement of the rotation mop.

In another example, the robot cleaner can perform a cleaning by sweeping the floor. However, in the case of sweeping type instead of a suction type, the shape of a rotation brush which can effectively perform a sweeping, the disposition of a dust container for storing the foreign substance, and the method of attaching and detaching the dust container may be important.

BRIEF DESCRIPTION OF THE DRAWINGS

The embodiments will be described in detail with reference to the following drawings in which like reference numerals refer to like elements wherein.

DETAILED DESCRIPTION

Figure 1:
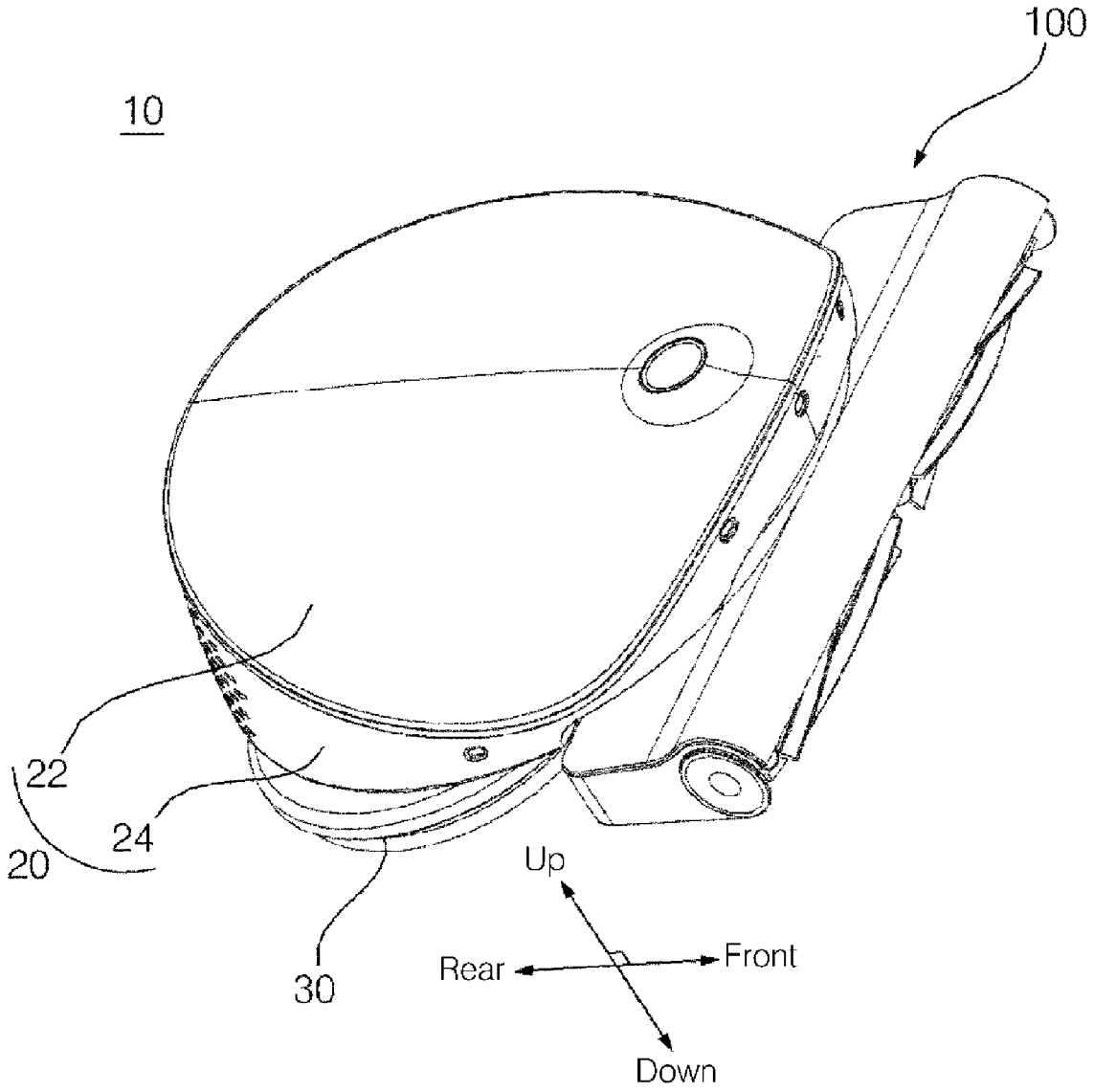
FIG. 1 is a perspective view of a robot cleaner according to an embodiment of the present application.
Figure 2:
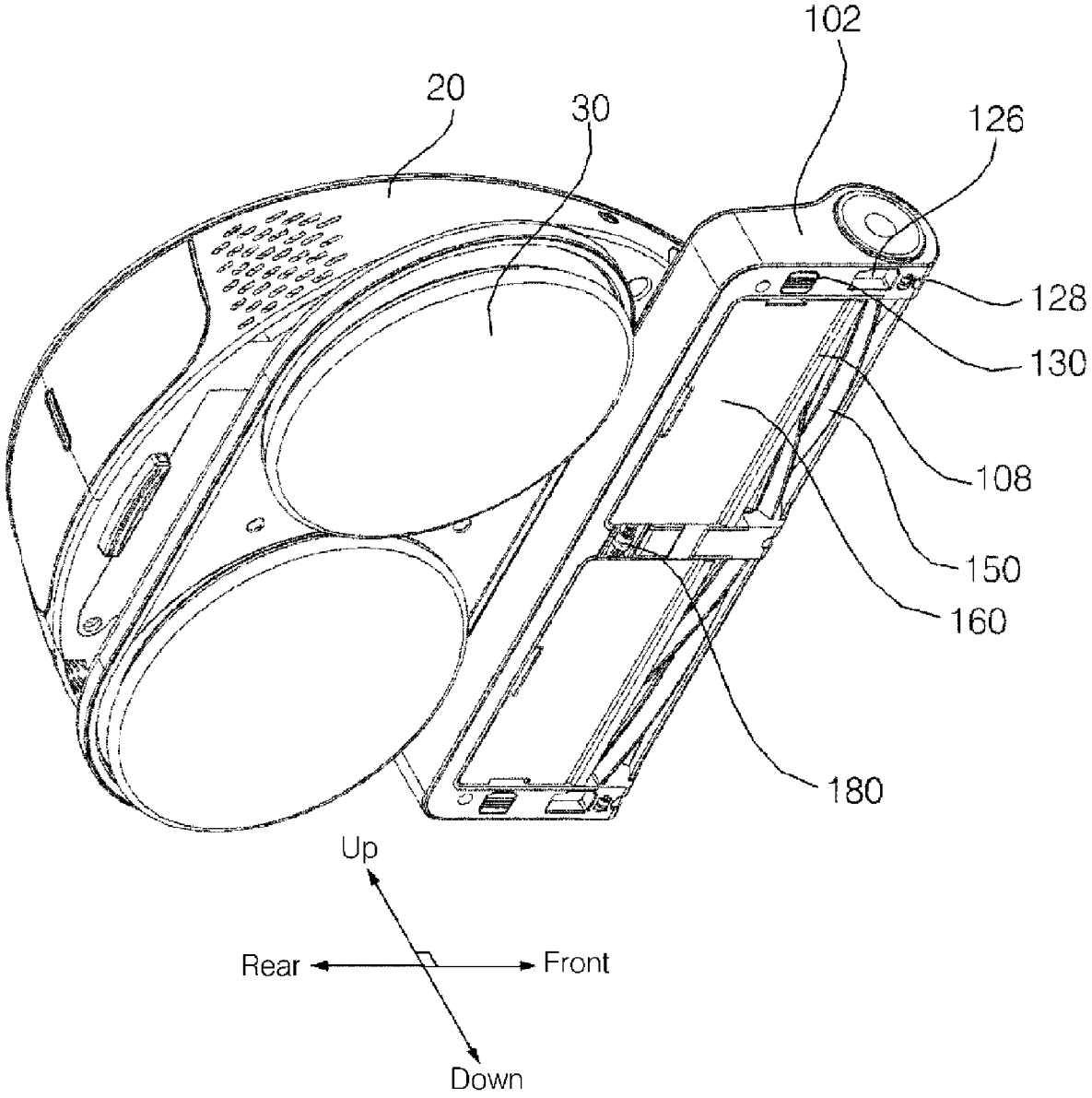
FIG. 2 is a bottom perspective view of the robot cleaner of FIG. 1.
Figure 3:
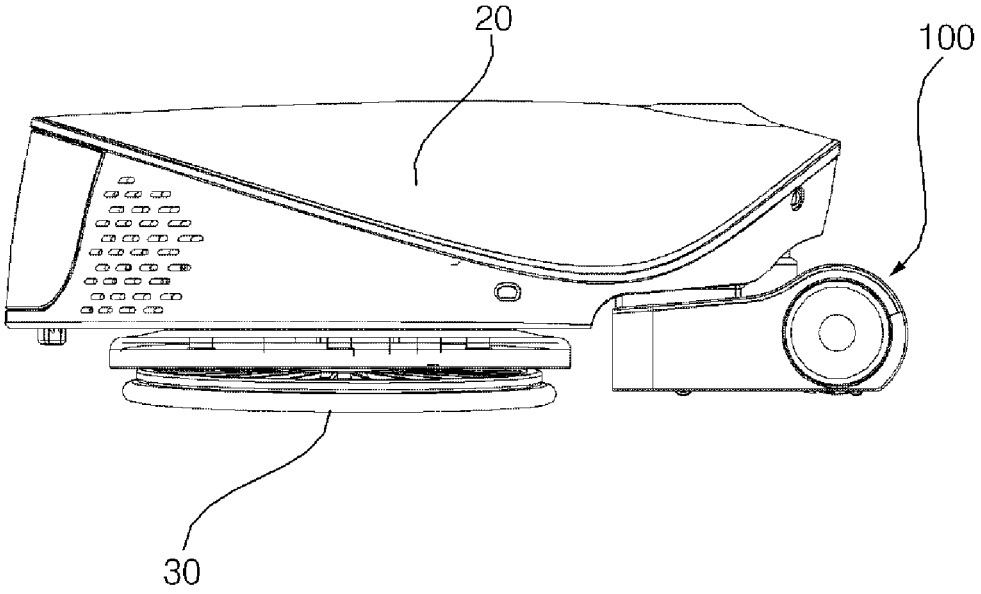
FIG. 3 is a side view of the robot cleaner of FIG. 1.

Exemplary embodiments of the present application are described with reference to the accompanying drawings in detail. The same reference numbers are used throughout the drawings to refer to the same or like parts. Detailed descriptions of well-known functions and structures incorporated herein may be omitted to avoid obscuring the subject matter of the present application. The following expressions of designating directions such as "front/rear/up/down" are defined as shown in the drawings, but this is only for the purpose of clarifying the present application, and it is obvious that each direction can be defined differently depending on a reference.

Hereinafter, a robot cleaner according to embodiments of the present application will be described with reference to the drawings. FIGS. 1-5 show various views of a robot cleaner 10 according to embodiments of the present application.

The robot cleaner 10 according to an embodiment may include a main body 20 which forms an outer shape of the robot cleaner 10, a moving mechanism which moves the main body 20, and a cleaning module (or cleaning head) 100 which is positioned in front of the main body 20 and collects foreign substance on a cleaning target surface.

The cleaning module 100 may include a housing 102 which is coupled to the main body 20 at an upper side thereof and opened at a lower side thereof; a dust container 160 which accommodates foreign substance introduced into the housing 102 and is detached from a lower side of the housing 102; and an agitator which is positioned inside the housing 102 and sends foreign substance on the cleaning target surface to the dust container 160 by a rotation operation.

The moving mechanism of the robot cleaner according to one embodiment may be a component to move the main body 20 and may include, for example, a driven wheel, a rolling mop, or a spin mop. In the examples provided in the present application, the moving mechanism of the robot cleaner may correspond to a spin mop 30 that rotates along a substantially vertical rotation axis (e.g., a rotation axis that between 0 to 45 degrees of vertical) to contact and wipe the floor. However, the present application is not limited thereto, as previously described, the robot cleaner 10 may move based on a driving force applied by a driven wheel, a rolling mop that rotates along a substantially horizontal rotation axis (e.g., a rotation axis that between 0 to 45 degrees of horizontal), or other moving mechanism.

The main body 20 of the robot cleaner 10 according to one embodiment may further include a spin mop driving motor (not shown) that drives the spin mop 30 and a controller (not shown) that manages the spin mop 30 and/or the driving motor. For example, controller may manage the power supplied to the driving motor, or to another motor (not shown) that adjust a position and/or angle of the spin mop 30. In addition, according to the function of the mobile robot, the main body 20 may further include a storage tank (not shown) to store water, a flow path (not shown) between the storage tank and the spin mop, and a pump (not shown) that selectively causes water to flow within the flow path. The spin mop 30, when turning to move the main body 20 and/to clean the floor, may receive water from the storage tank and wipe a cleaning target surface with a dampened surface, such as a bottom cloth mopping pad. Accordingly, the robot cleaner according to one embodiment may include spin mop 30 that spins to move the cleaning module 10 to remove foreign substance from a target surface and to further wipe the target surface with a damp cloth.

The main body 20 according to one embodiment may include an upper cover 22 which covers an upper portion thereof to protect an internal configuration and a base 24 which is coupled to the spin mop 30 or the cleaning module 100.

Figure 4:
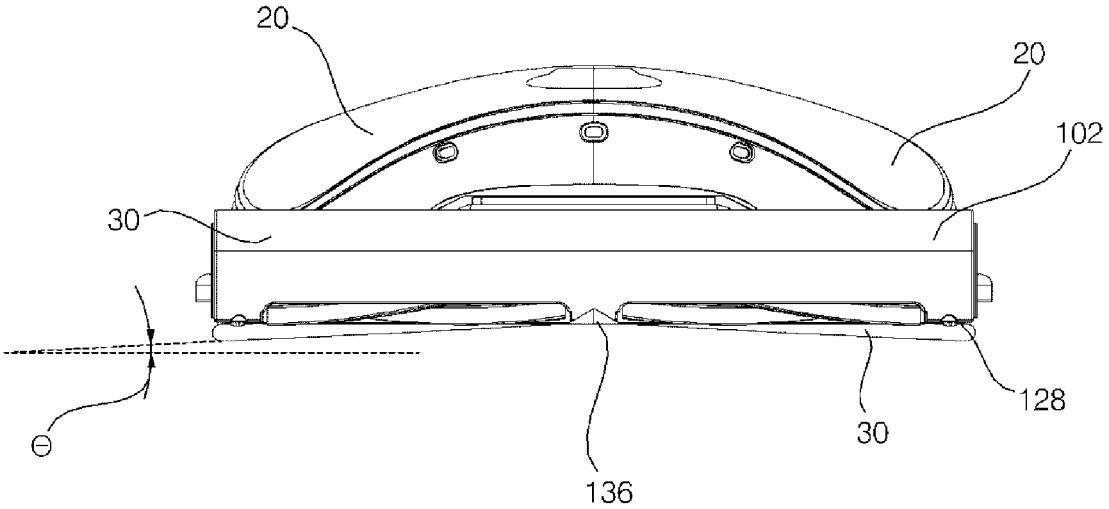
FIG. 4 is a front view of the robot cleaner of FIG. 1.

Referring to FIG. 4, the robot cleaner 10 according to one embodiment may be positioned in such a manner that the spin mop 30 is inclined by a certain angle (θ) with respect to the floor surface. In order to facilitate the movement of the robot cleaner 10, it may be positioned in such a manner that the entire surface of the spin mop 50 is not evenly in contact with the floor surface but is tilted by the certain angle (θ) so that a certain portion of the spin mop (e.g., an outside lateral edge) is mainly in contact with the floor surface. In addition, even if a substantially entire surface of the spin mop 30 is in contact with the floor surface, the spin mop 30 may be inclined by the certain angle (θ) so that a load is increased in a certain portion of the spin mop 30 that is angled toward the floor.

The main body 20 may be coupled to the cleaning module 100 at one side thereof. The cleaning module 100 according to one embodiment may be positioned in front of the spin mop of the robot cleaner 10. As used herein, the "front" of the main body 20 may refer to a location of the cleaning module 100 on the main body. The upper side of the cleaning module 100 according to one embodiment may be coupled to a lower surface of one side of the main body 20. The cleaning module 100 may be positioned at a lower side of a portion of the main body 20, such as below a portion of the upper cover 22.

Figure 5:
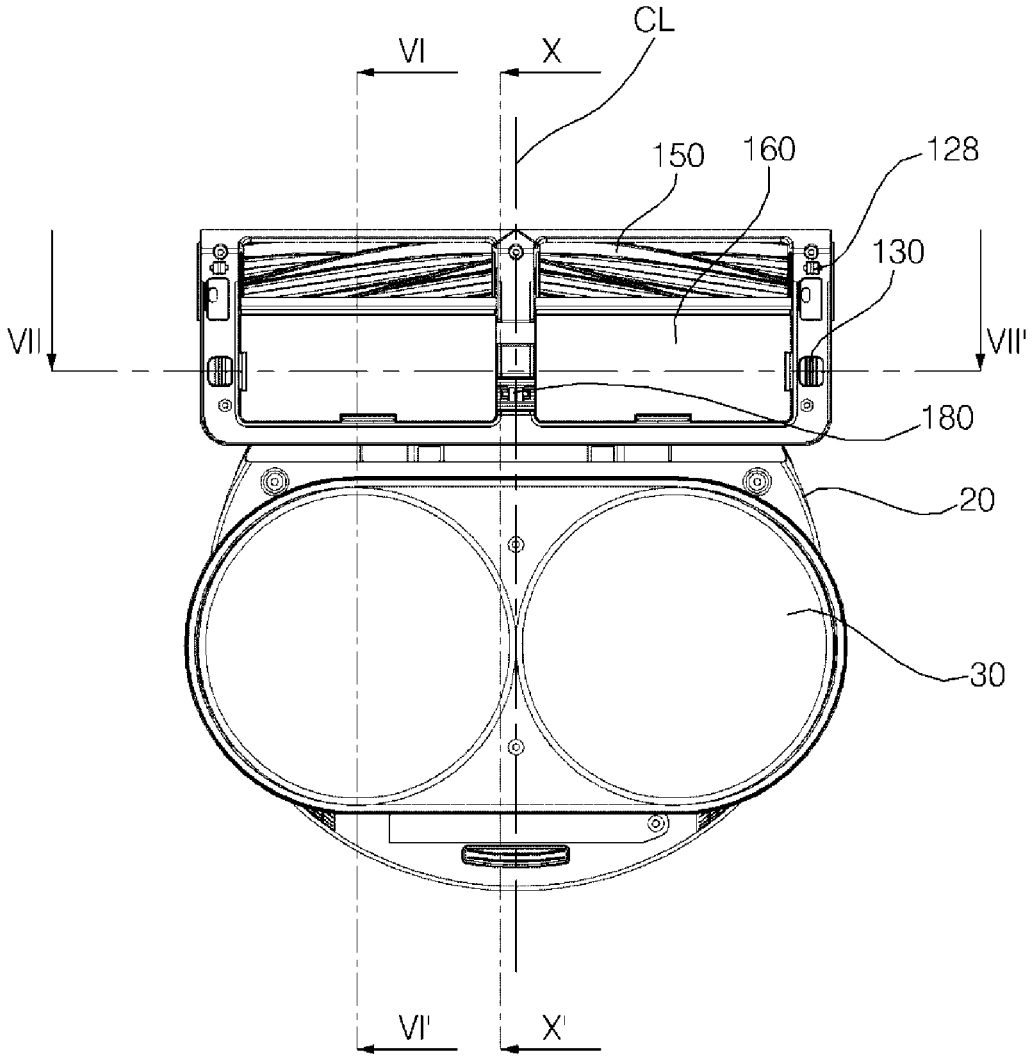
FIG. 5 is a bottom view of the robot cleaner of FIG. 1.
Figure 6:
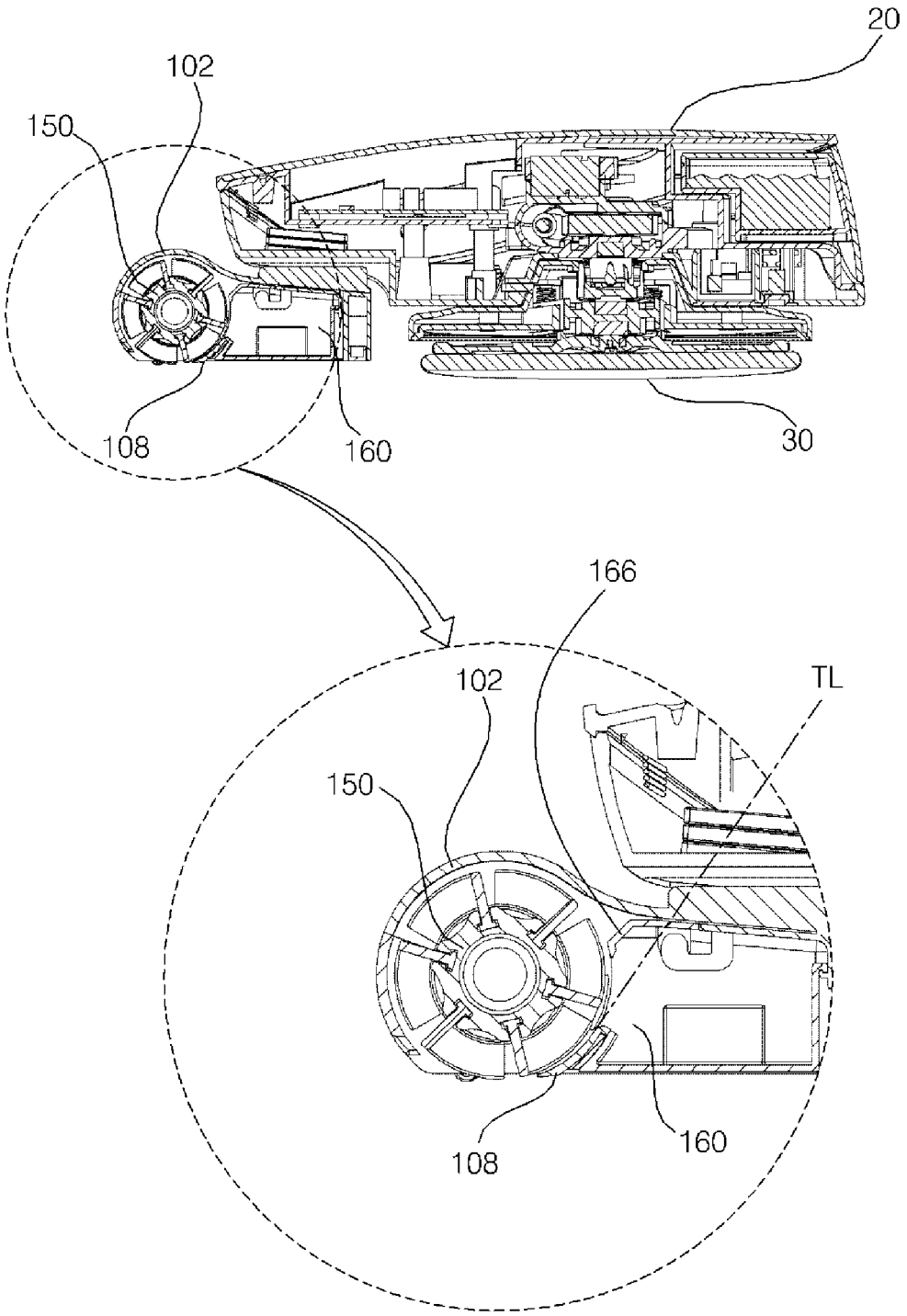
FIG. 6 is a cross-sectional view of the robot cleaner taken along a line VI-VI' of FIG. 5.
Figure 7:
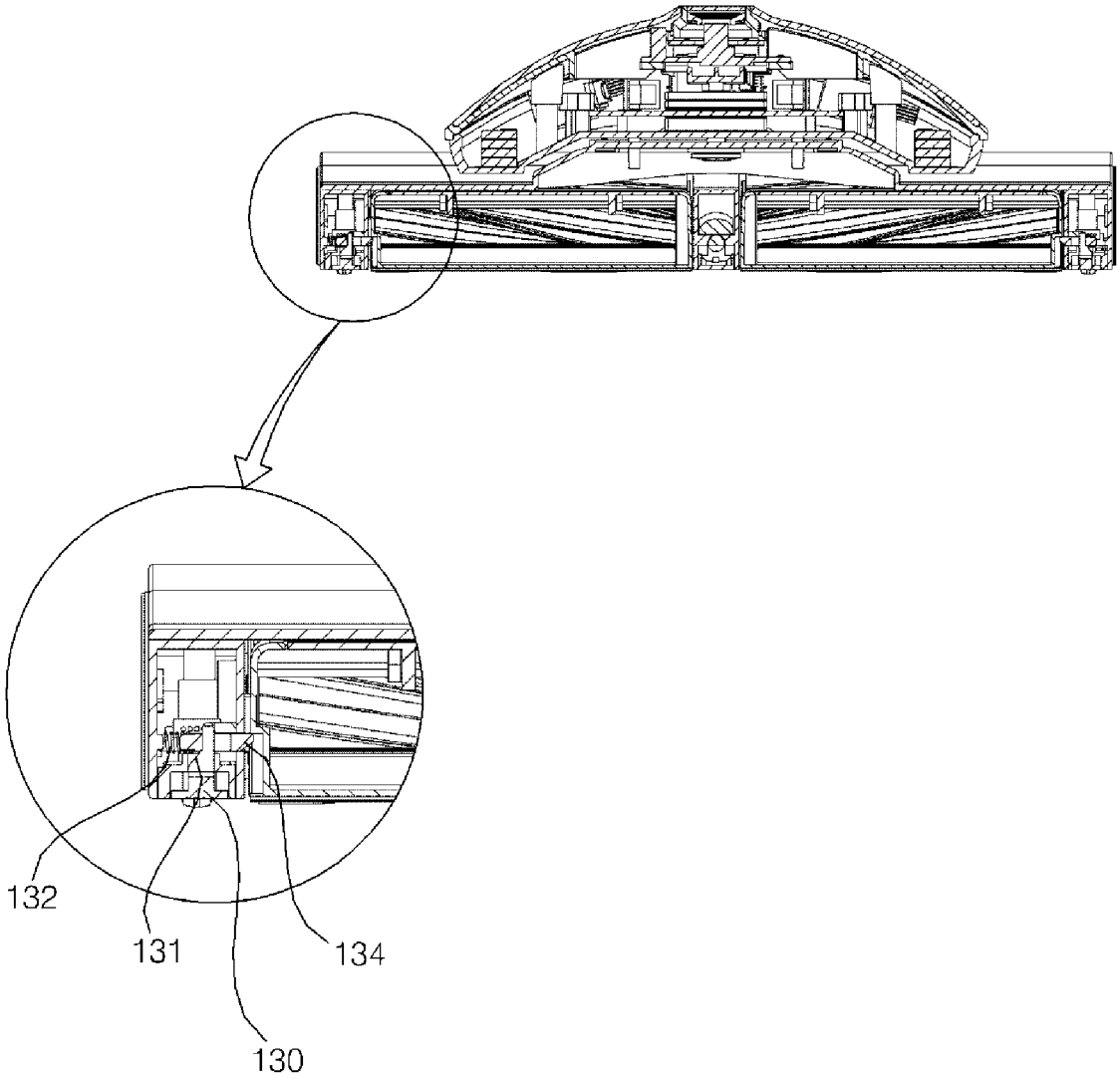
FIG. 7 is a cross-sectional view of the robot cleaner taken along a line VII-VII' of FIG. 5, and a partially enlarged view.
Figure 8:
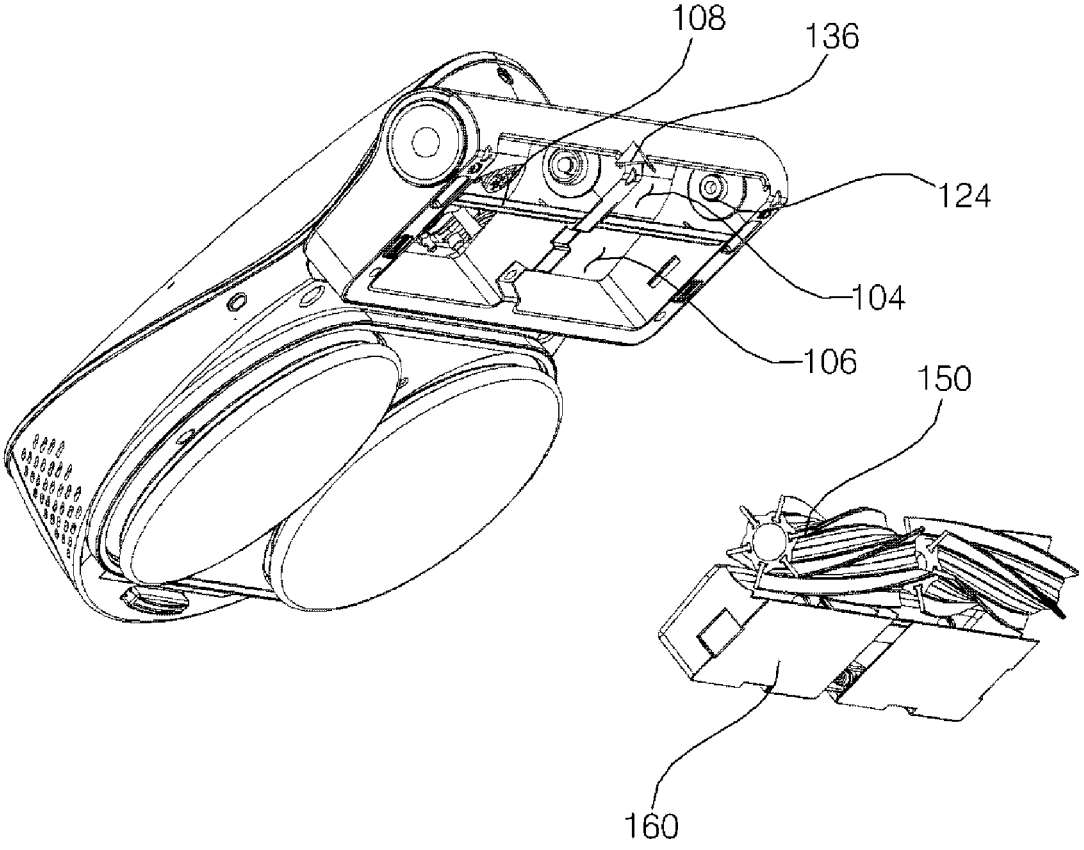
FIG. 8 is a view illustrating a state in which an agitator and a dust container of a robot cleaner are separated from each other according to an embodiment of the present application.
Figure 9:
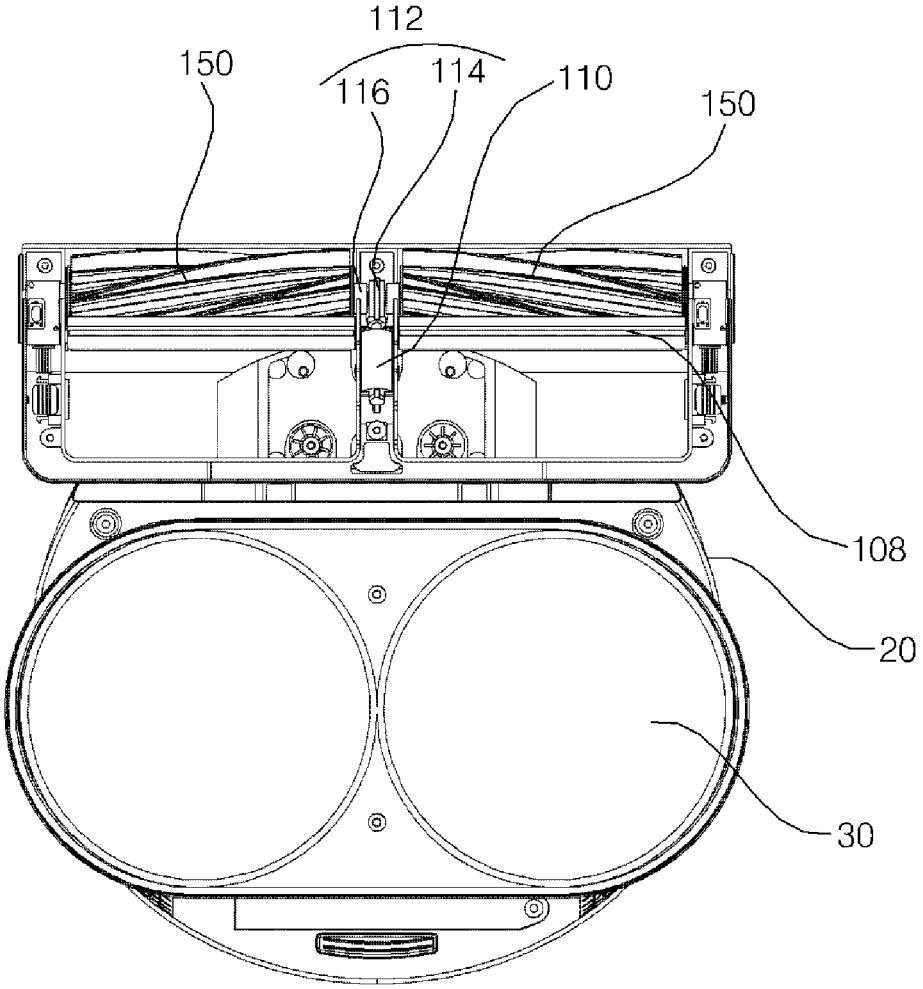
FIG. 9 is a view for explaining a motor and a transmission gear of a robot cleaner according to an embodiment of the present application.
Figure 10:
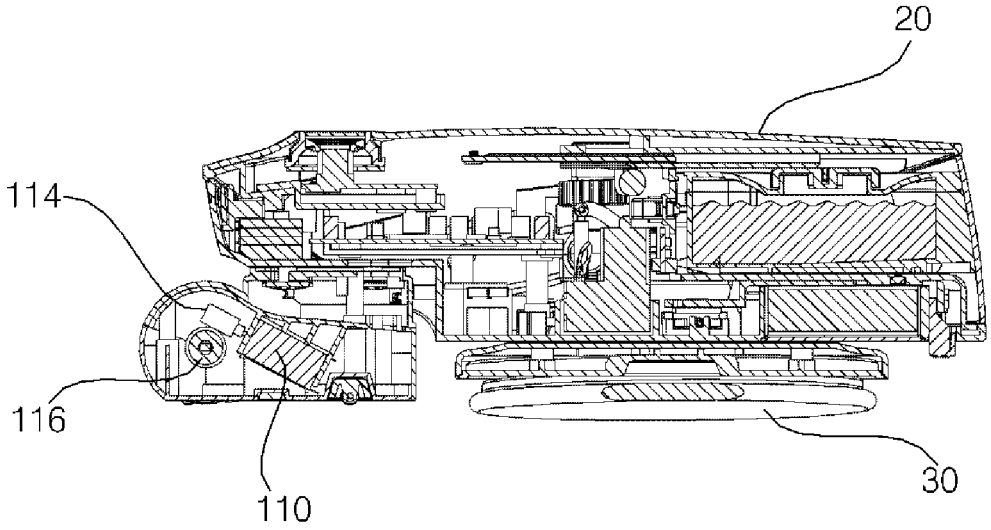
FIG. 10 is a cross-sectional view of the robot cleaner taken along a line X-X' of FIG. 5.
Figure 11:
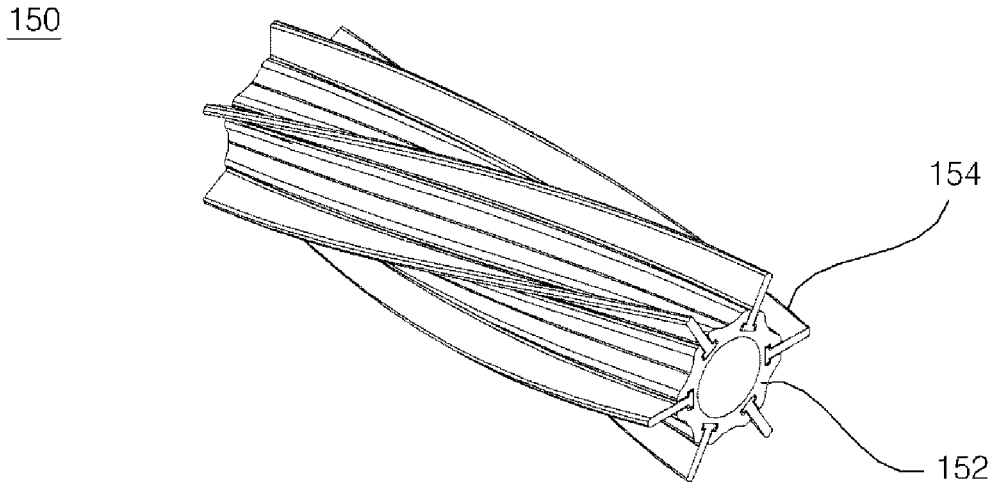
FIG. 11 is a perspective view of an agitator according to an embodiment of the present application.
Figure 12:
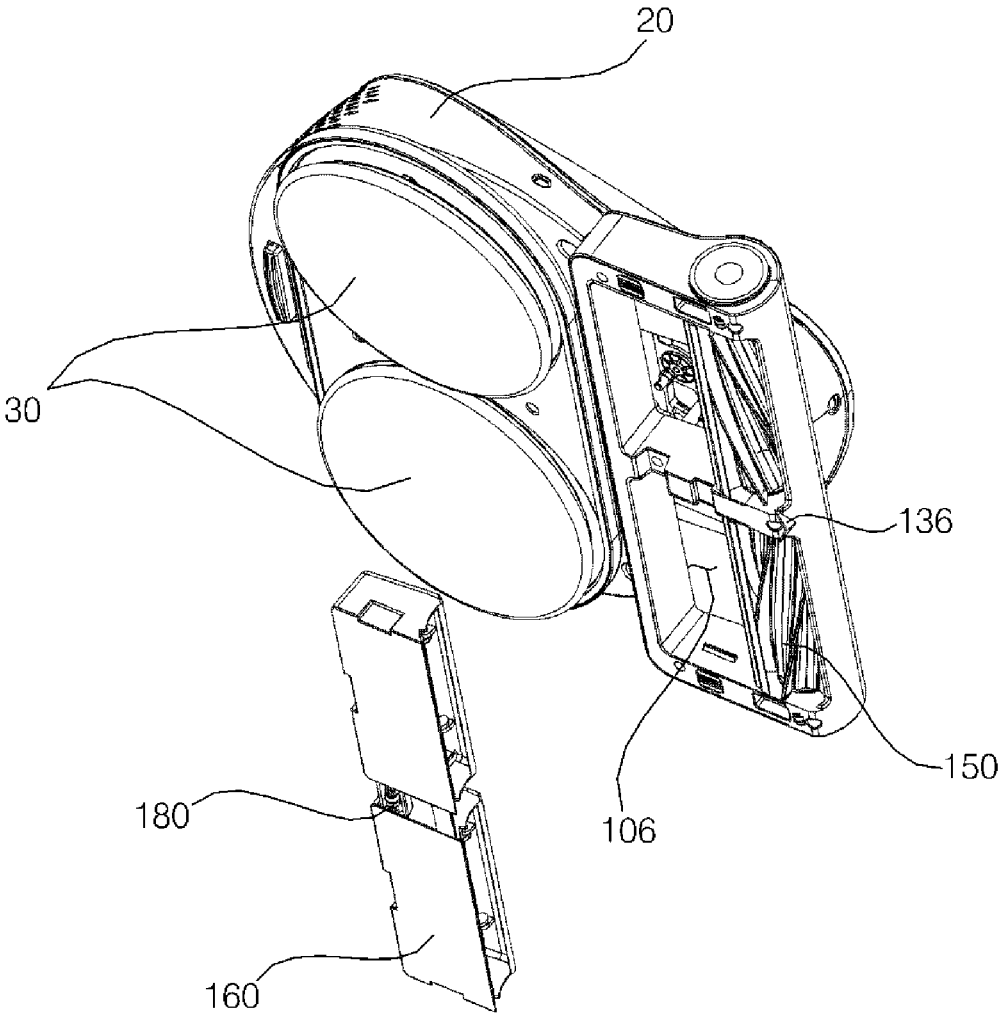
FIG. 12 is a view illustrating a state in which a dust container of a robot cleaner according to an embodiment of the present application is separated.
Figure 13:
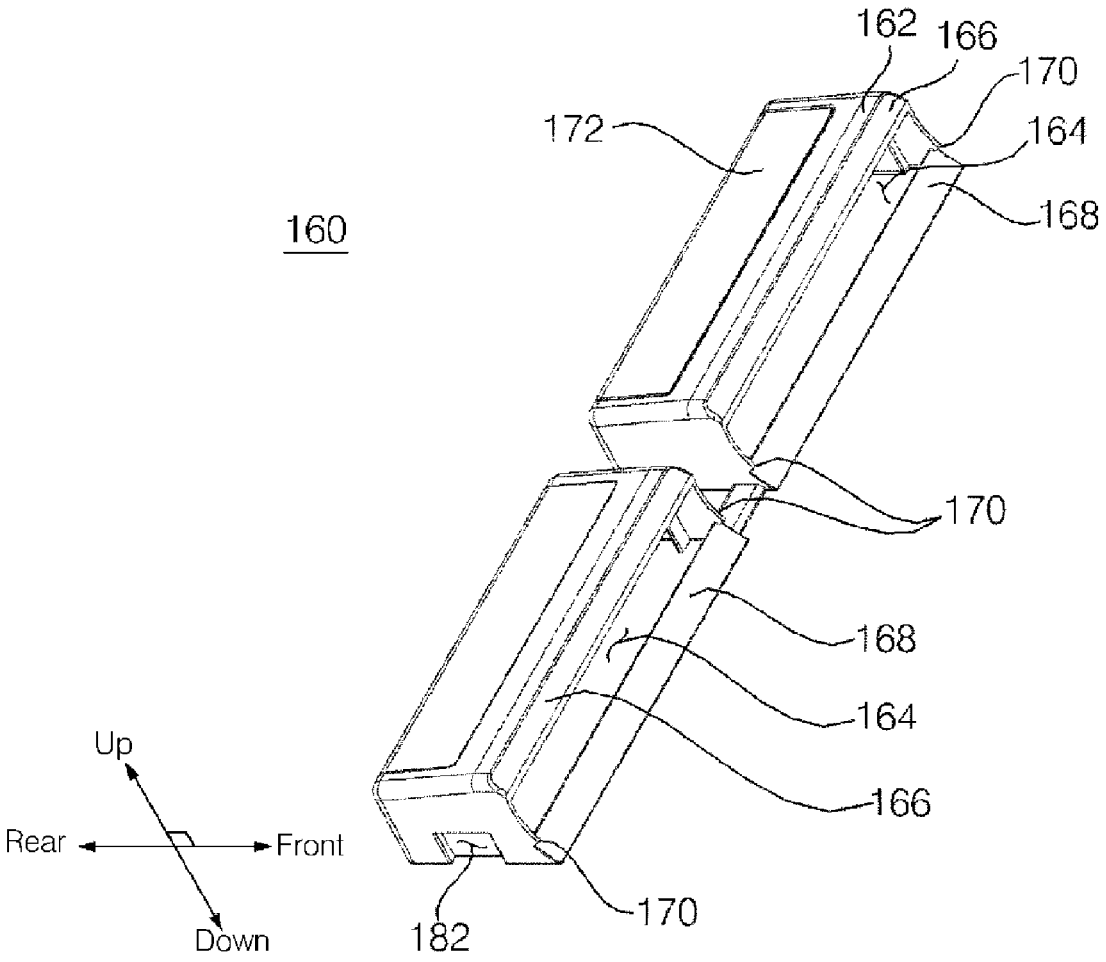
FIG. 13 is a perspective view of a dust container according to an embodiment of the present application.
Figure 14:
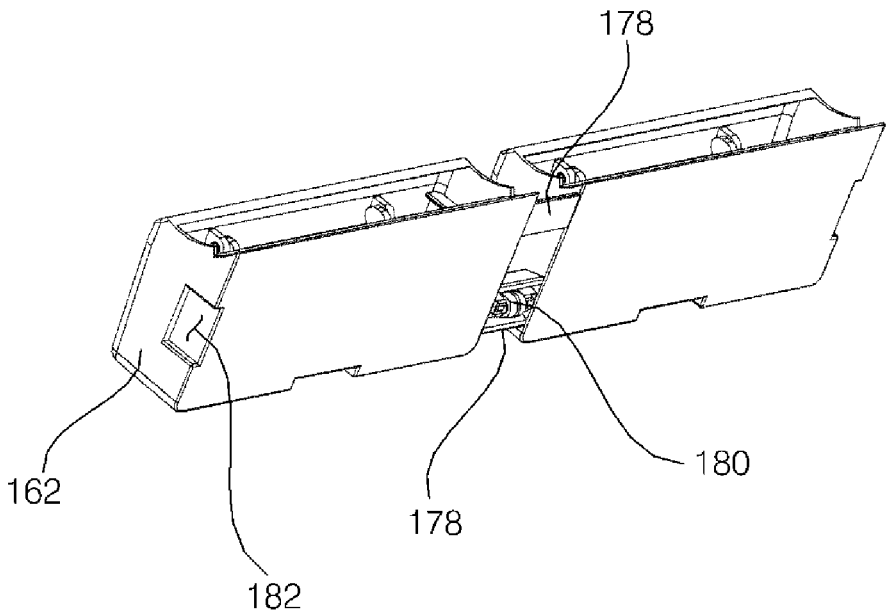
FIG. 14 is a bottom perspective view of the dust container of FIG. 13.
Figure 15:
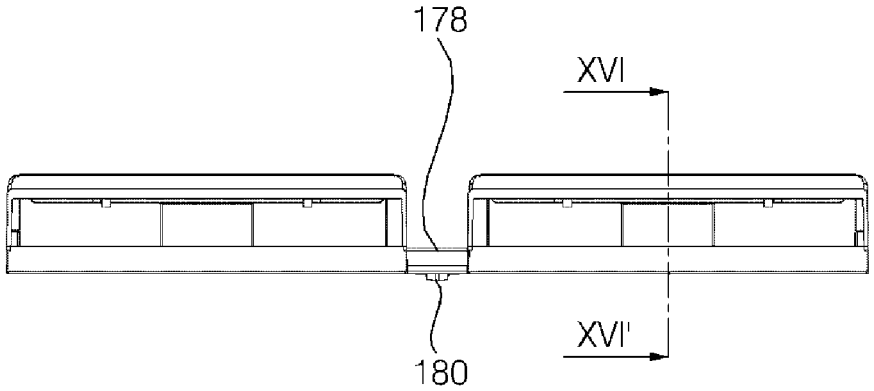
FIG. 15 is a front view of the dust container of FIG. 13.
Figure 16:
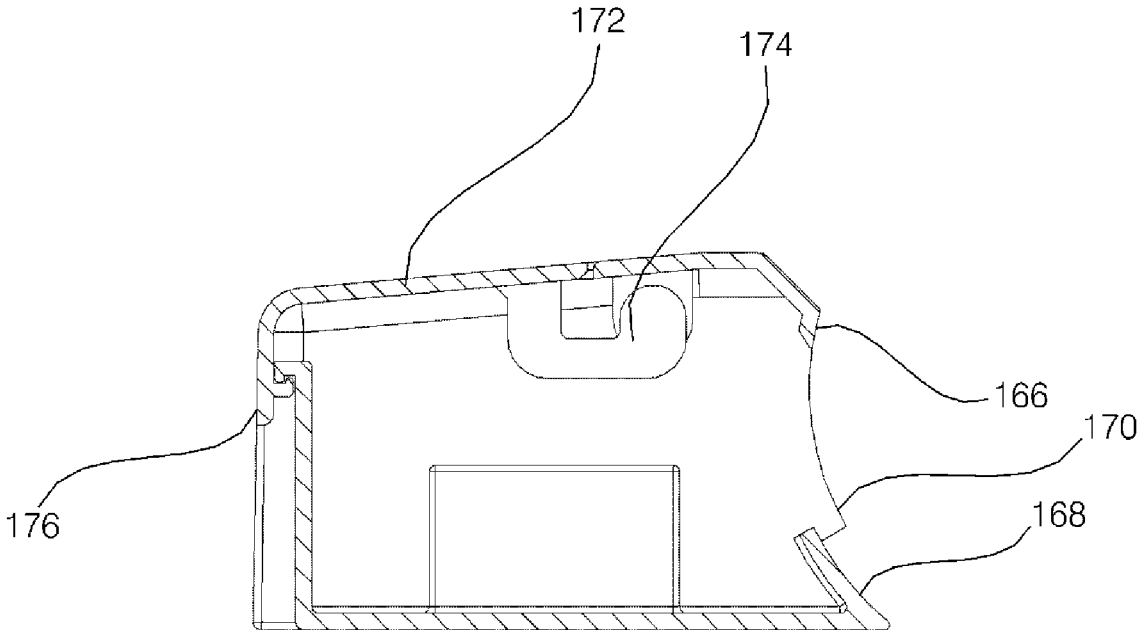
FIG. 16 is a cross-sectional view of the dust container taken along a line XVI-XVI' of FIG. 15.

FIG. 6 is a cross-sectional view taken along a line VI-VI' of FIG. 5. FIG. 7 is a cross-sectional view taken along a line VII-VII' of FIG. 5, and a partially enlarged view. FIG. 8 is a view illustrating a state in which an agitator and a dust container of a robot cleaner are separated from each other according to an embodiment of the present application. FIG. 9 is a view for explaining a motor and a transmission gear of a robot cleaner according to an embodiment of the present application. FIG. 10 is a cross-sectional view taken along a line X-X' of FIG. 5. FIG. 11 is a perspective view of an agitator according to an embodiment of the present application. FIG. 12 is a view illustrating a state in which a dust container of a robot cleaner according to an embodiment of the present application is separated. FIG. 13 is a perspective view of a dust container according to an embodiment of the present application. FIG. 14 is a bottom perspective view of FIG. 13. FIG. 15 is a front view of FIG. 13. FIG. 16 is a cross-sectional view taken along a line XVI-XVI' of FIG. 15.

The cleaning module 100 according to one embodiment may include a housing 102 which is coupled to the main body 20 and is opened at a lower side thereof; a dust container (or dust bin) 160 which accommodates dust and other foreign substance introduced into the housing 102 and is detached from a lower side of the housing 102; and an agitator 150 which is positioned inside the housing 102 and rotates to direct dust or other foreign substances on a cleaning target surface into the housing 102 and toward the dust container 160.

The housing 102 according to one embodiment may form an outer shape of the cleaning module 100 and may be positioned in the lower portion of the main body 20 (e.g., facing a floor surface being cleaned). The housing 102 may be positioned in the front lower side of the main body 20. The housing 102 may be positioned in front of the spin mop 30.

The housing 102 may define a first space 104 in which the agitator 150 is accommodated and a second space 106 in which the dust container 160 is accommodated. The lower side of the housing 102 may be opened to receive the dust container 160 in the space 106. The housing may have a front lower side that is opened to receive and accommodate the agitator 150. The lower side of the housing may be opened so that a part of the agitator 150 accommodated in the housing 102 is exposed toward the floor surface to be cleaned, such as to allow a portion of the agitator 150 to extend outward from the housing 102 and toward the floor.

The housing 102 may include a guide unit (or guide wall) 108 that at least partially partitions the first space 104 and second space 106 in which the agitator 150 and the dust container are accommodated. A surface of the guide unit 108 may have a shape corresponding to the outer circumference of the agitator 150. The guide unit 108 may guide the foreign substance, which moves along the outer circumference of agitator due to the rotation of the agitator 150, to move inward along an inlet 164 of the dust container 160. Referring to FIG. 6, an extension line TL of a tangent line formed at the upper end of the guide unit 108 may extend rearward than an upper front portion (or upper front wall) 166 of dust container 160, as described later.

A portion of the guide unit 108 may protrude toward the lower side of the lower surface of the housing 102. The guide unit 108 may protrude toward the lower side of the housing 102 so that the foreign substance moving rearward due to the rotation of the agitator 150 may move into the dust container 160.

The guide unit 108 according to one embodiment may be configured to be fixed to the front lower side of the dust container 160. Therefore, the guide unit 108 may be fixed to a lower front portion (or lower front wall) 168 of the dust container 160. In this configuration, when the dust container 160 is detached from the housing 102, the guide unit 108 may be detached from the housing 102 together with the dust container 160.

A driving motor 110 to drive a rotation of the agitator 150 may be positioned in the housing 102. The cleaning module 100 according to one embodiment may include two or more agitators 150 driven by a single driving motor 110, and the driving motor 110 may be positioned between two of the agitators 150 (see FIG. 9).

In the robot cleaner 10 according to one embodiment, the rotation axis of the agitator 150 and the rotation axis of a drive shaft of the driving motor 110 may be vertically separated. The cleaning module 100 according to one embodiment may include a transmission gear 112 that transfers the rotational force of the driving motor 110 to the agitator 150.

The transmission gear 112 according to one embodiment may use a worm gear 114 which rotates while being coupled to the driving motor 110 and a worm wheel 116 which is coupled to the worm gear 114 and transmits the rotational force of the driving motor 110 to the agitator 150. However, in other embodiments, a helical gear, a spiral bevel gear, or the like which can be used transmit the rotational force in a vertical direction can be used to transmit the rotational force of the driving motor 110 to the agitator 150.

The cleaning module 100 according to one embodiment may include couplers 122, 124 which are positioned in opposite ends of the agitator 150 and rotatably coupled to the agitator 150 inside the housing 102. The coupler 122, 124 may be positioned inside the housing 102 in which the agitator 150 is accommodated. The coupler 122, 124 may include a first coupler 122 coupled to one end of the agitator 150 to transmit the rotational force of the driving motor 110, and a second coupler 124 rotatably connecting another end of the agitator 150 to the inside of the housing 102.

The robot cleaner 10 according to one embodiment may not include a driving motor 110. In this configuration, the agitator 150 may rotate by making contact with a cleaning target surface, and both the first coupler 122 and the second coupler 124 may rotatably couple the agitator 150 to the inside of the housing.

The housing 102 according to one embodiment may further include a dust container fixing member (or fixing extension) 134 that selectively fixes the dust container 160 to the inside thereof. The dust container fixing member 134 may be positioned extend to fix the dust container to the interior of the housing 102 or may be positioned to allow the dust container 160 to be taken out of the housing 102. The housing 102 may also include an elastic member 132 that applies an elastic force to the fixing member 134 to cause fixing member 134 to move to engage or otherwise fix a portion of the dust container 102, and a push button 130 that releases the elastic force applied to the fixing member 134 such that the fixing member 134 moves away from the dust container 134.

The fixing member 134 may protrude into the space 106 formed inside the housing 102 that accommodates the dust container 160 due to the elastic force of the elastic member 132, when no external force is applied. When the fixing member 134 protrudes to the space 106 accommodating the dust container 160, the fixing member 134 may be caught by a latching jaw 182 of the dust container 160 (see FIG. 13) to fix the dust container 160 inside the housing 102.

When a force is applied to the push button 130, the fixing member 134 may move in a direction the outward from the dust container 160. When the fixing of the latching jaw 182 is released by the movement of the fixing member 134, the dust container 160 may be taken out of the housing.

The push button 130 may be positioned on the bottom surface of the housing and may include an inclined plane 131 that is formed at a portion contacting the fixing member 134. The movement direction of the push button 130 may be formed to be perpendicular to the movement direction of the fixing member 134. Therefore, when the push button 134 is pressed by a user, the inclined plane 131 contacting the fixing member 134 may move, and the fixing member 134 may move in the outward direction of the dust container 160.

The robot cleaner 10 according to one embodiment may include a cliff sensor 126 to detect an obstacle on the floor supporting the main body 20. The cliff sensor 126 may be positioned in the housing 102 of the cleaning module 100. The cliff sensor 126 may be positioned in the housing 102 of the cleaning module 100 to sense an obstacle in the movement direction of the robot cleaner.

The robot cleaner 10 according to one embodiment may further include a roller (or wheel) 128, 180 to space the lower surface of the housing 102 from the cleaning target surface by a certain distance. The roller 128, 180 may rotate to aid in a movement of the cleaning module 100. The roller may be positioned to protrude from the lower side of the lower surface of the housing. The roller 128, 180 according to one embodiment may be positioned in the lower surface of the housing 102 or the dust container 160 described below. The roller 128, 180 according to one embodiment may include a first roller 128 positioned in the lower surface of the housing and a second roller 180 positioned in the lower surface of the dust container 160.

The robot cleaner according to one embodiment may include a guider (or guide recess) 136 that guides the foreign substance adjacent to the cleaning module 100 to the agitator 150. The guider 136 may be positioned between two of agitators 150. The guider 136 may also extend or otherwise be positioned in front of the agitators 150. The guider 136 may direct a foreign substance in front of the cleaning module 100 toward one of the agitators 150 positioned at a side of the guider 136.

The agitator 150 may send the foreign substance on the floor surface to the dust container 160 by a rotation operation. The agitator 150 may be positioned in an inner space of the housing 102. For example, the agitator 150 may be positioned, inside the housing 102 and in front of the dust container 160. The agitator 150 may rotate in a particular direction (e.g., in a circumferential direction extending from the floor surface and to the dust container 160) to send foreign substances on the floor surface toward the dust container 160 positioned in the rear of the agitator 150.

A part of the agitator 150 may be positioned to protrude to the lower side of the housing 102. The length of the portion of the agitator 150 protruding downward out of the housing 102 may be smaller than or equal to the length of the rollers 128, 180 that protrude from the lower surface to separate the lower surface of the housing 102 from the cleaning target surface by a certain distance.

The agitator 150 according to one embodiment may include a rotation bar (or shaft) 152 that rotates based on a rotation axis parallel to the cleaning target surface (e.g., a substantially parallel rotation axis), and a plurality of blades 154 which protrude in the radial direction from the outer circumferential surface of the rotation bar 152. Additionally, the blades 154 may be spirally positioned along the outer circumference of the rotation bar 152. In other examples, brushes, protrusions, non-spiraling blades, or other structures may extend from the outer circumferential surface of the rotation bar 152.

Both ends of the rotation bar 152 may be connected to the housing 102 by the couplers 122, 124. The rotation bar 152 may rotate due to a rotation force received from the driving motor 110. One end of the rotation bar 152 may be coupled to the first coupler 122 that transfers the rotational force of the driving motor 110 and the other end of the rotation bar 152 may be coupled to the second coupler 124 that assists the rotation of the rotation bar 152 in the housing 102. For example, the rotation bar 152 may have a substantially round end shape, and the second coupler 124 may include a receiving cavity that is substantially round and sized to receive the end of the rotation bar 152 such that the rotation bar can freely rotate when received in the second coupler 124.

The blade 154 may be positioned spirally along the circumferential surface of the rotation bar 152. The plurality of blades 154 according to one embodiment are positioned at a certain interval along the circumferential surface of the rotation bar 152. When the agitator 150 rotates, the outer side or end of the blade 154 may be in contact with the guide unit 108 of the housing 102. When the agitator 150 rotates, the outer side of the blade 154 may contact the floor surface being cleaned. A foreign substance on the cleaning target surface may move to the dust container 160 through the guide unit 108 due to the rotation of the agitator 150. The agitator 150 may send the foreign substance on the floor surface to the dust container 160 along the guide unit 108. The blade 154 may be formed of an elastic member capable of reducing the leakage of the floor. The blade may be configured, for example, in the form of a brush or squeegee.

The cleaning module 100 according to one embodiment may include two or more agitators 150. Two of the agitators 150 may be positioned to be spaced apart at a certain interval on the same rotation axis. A driving motor 110 that provides a driving force for rotating the agitators 150 may be positioned between the pair of agitators 150. Between a pair of agitators 150, a central guider 136 may be positioned to guide foreign substance in front of the cleaning module 100 to the two agitators 150.

Referring to FIG. 5, a pair of agitators 150 may be positioned symmetrically based on a virtual centerline (CL) that divides the cleaning module 100 into left and right sides. The blade 154 positioned on each of the agitators 150 may be positioned symmetrically based on a virtual center line CL that divides the cleaning module into left and right sides.

The dust container 160 according to one embodiment may collect and store the foreign substance that moves rearward and into the housing 102 due to the rotation of the agitator 150. The dust container 160 may be positioned behind the agitator 150 and inside the housing 102. The dust container 160 may be inserted into the open lower side of the housing 102 (e.g., into the space 106 formed by the housing 102).

The dust container 160 according to one embodiment may include a case 162 which forms an outer shape and is inserted into the housing 102, and an upper cover 172 which opens and closes the upper side of the case 162. The dust container 160 according to one embodiment may further include a hinge member (or hinge) 174 that selectively opens and closes the upper cover 172 and a fixing member (or clasp) 176 that couples to another surface of the case 162, such as a rear vertical wall, to keep the upper cover 172 closed in the dust container. The hinge member 174 according to one embodiment may be positioned inside the dust container 160 to rotate the upper cover 172 in the outer direction of the dust container 160. The fixing member 176 according to one embodiment may be positioned in the end of the upper cover 172 and hook the upper cover 172 to the dust container 160.

A surface of the case 162 facing the agitator 150 may have a shape (e.g., is concave) corresponding to the outer circumference of the agitator 150, and may be partially opened. A front portion of the case 162 may have a shape (e.g., is concave) corresponding to the outer circumference of the agitator 150, and a part thereof may be opened. An inlet 164 which introduces foreign substance by the rotation of the agitator may be formed in the front portion of the case. The front portion of the case may be divided into an upper front portion (or upper front wall) 166 positioned in the upper side of the inlet 164 and a lower front portion 168 positioned in the lower side of the inlet 164.

Referring to FIG. 6, the upper front portion 166 may be positioned in front of an extension line TL of a tangential line formed by the upper end of the guide unit 108 positioned in front of the dust container 160. Therefore, the foreign substance that moves along the guide unit 108 due to the rotation of the agitator 150 may be introduced into an interior of the dust container 160, which is located behind the upper front portion 166 of the dust container 160.

The lower front portion 168 of the case 162 may be positioned behind the guide unit 108 of the housing 102. The lower front portion 168 of the case may protrude from the lower portion of the dust container 160 to prevent the foreign substance inside the dust container 16—from being inadvertently discharged out of the dust container, such as being blown out of the dust container 160 due an air flow generated by the rotation of the one or more agitators 150.

A side protrusion 170 that extends forward may be formed in the side of the case 102, and may protrude forward from both ends of the lower front portion 168. The side protrusion 170 may project forward from both sides of the lower front portion 168. The side protrusion 170 may be in contact with both ends of the guide unit 108 of the housing 102 to fix the dust container 160 to the interior of the housing. The side protrusion 170 may guide the foreign substance moved by the rotation of the agitator to move into the dust container 160.

The cleaning module 100 according to one embodiment may include two or more dust containers 160 that accommodate foreign substance behind the pair of agitators. Each of the dust containers 160 may be positioned behind a corresponding one of the agitators 150. The two of dust containers 160 may be coupled by a connection unit (or connection wall) 178 to form a united structure. In the dust container 160 according to one embodiment, a second roller 180 may be positioned on a lower surface of the connection unit 178 or the dust container 160 to separate the dust container 160 from the floor surface being a cleaning target surface by a certain distance.

Each of the dust containers 160 may be coupled to a connection unit (or connection wall) 178 at one side. Each of the pair of dust containers 160 may be formed with a latching jaw which is fixed to the inside of the housing at the other side not coupled to the connection unit. The latching jaw 182 may be engaged with the fixing member 134 protruded to the inside of the housing 102.

FIGS. 17A-17C and 18A-18C are bottom views and cross-sectional views of a cleaning module 100 for explaining the operation of the agitator according to the embodiment of the present application. Hereinafter, the operation of the cleaning module 100 according to one embodiment will be described with reference to FIGS. 17A-17C and FIGS. 18A-18C.

The blade 154*a*, 154*b*, 154*c* of the agitator 150 according to one embodiment may be radially protruded from the outer circumference of the rotation bar 152 and may be positioned in a spiral direction. Additionally, the blades 154*a*, 154*b*, 154*c* may include an enlarged end positioned within a slot or opening of the rotation bar 152 to couple the blades 154*a*, 154*b*, 154*c* to the rotation bar 152. The agitator 150 according to one embodiment may be positioned to incline rearward based on a virtual center line which divides the cleaning module into the left and right sides by the blade 154*a*, 154*b*, 154*c*. The guider 136 positioned in front of the pair of agitators 150 may have a 'V' shape dispreading rearward. The guider 136 may be positioned to be inclined rearward based on the center line CL. As the robot cleaner 10 moves, the guider 136 may guide the foreign substances positioned in front of the cleaning module 100 to the agitators 150 positioned in the left and right rear sides of the guider 136.

Figure 17A:
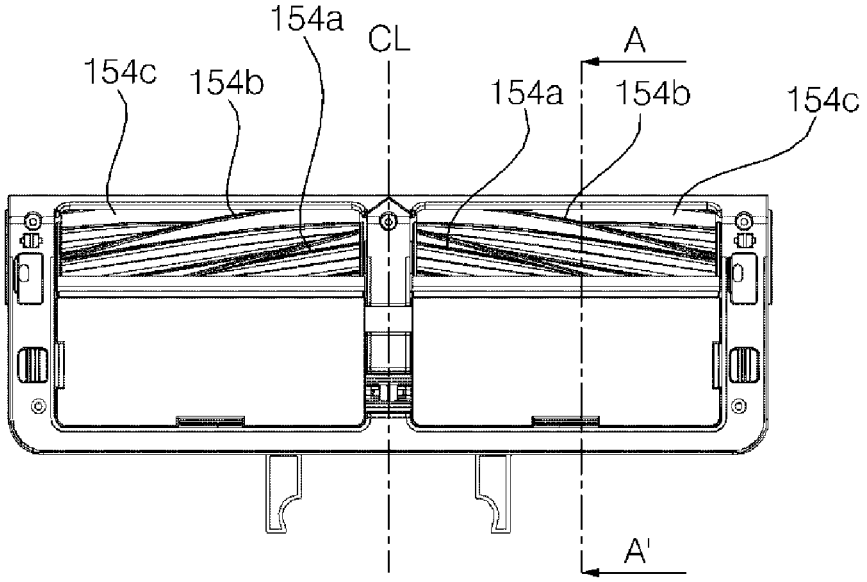
FIGS. 17A, 17B, and 17C are views for explaining operation of an agitator according to an embodiment of the present application, and showing a change of an agitator in chronological order.
Figure 17B:
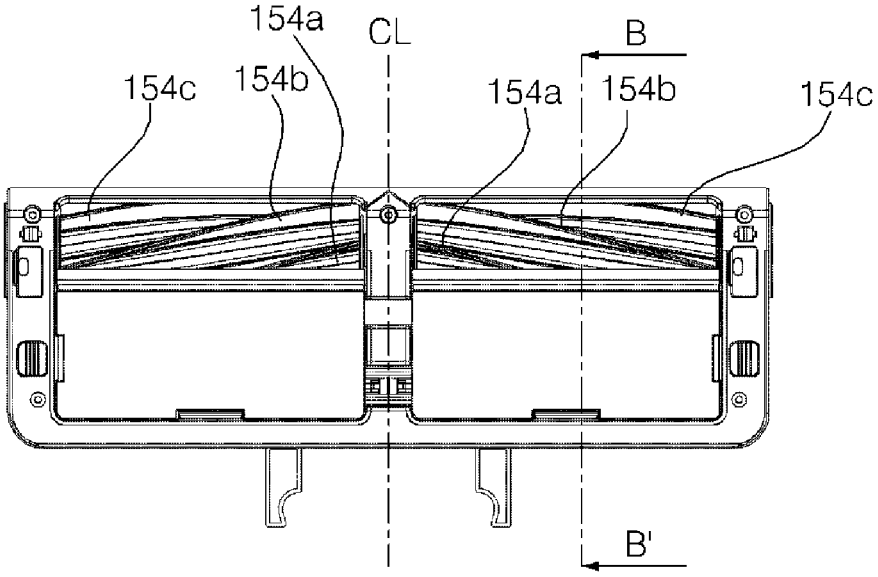
Figure 17C:
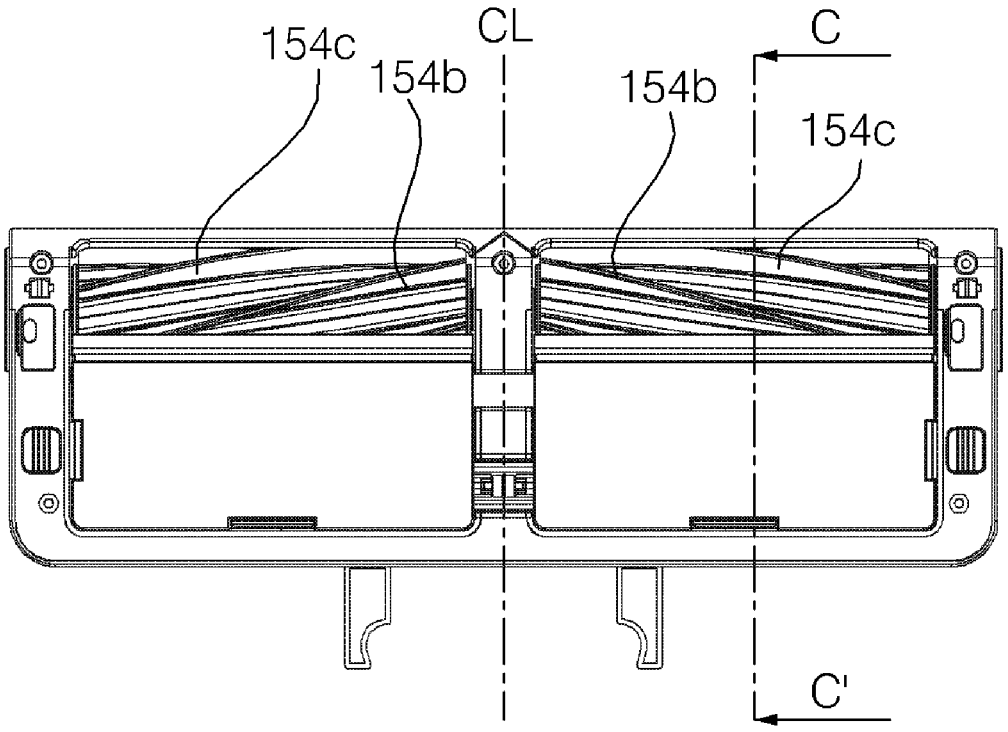

Referring to FIG. 17A to FIG. 17C, due to the operation of the driving motor 110, each of the blades 154*a*, 154*b* 154*c* may rotate as if it moves to the center, and the disposition of such blade blades 154*a*, 154*b* 154*c* may make it possible to move the foreign substance in the direction of the center line. According to the disposition of the blades 154*a*, 154*b* 154*c* as shown in FIGS. 17A-17C, the agitator 150 may rotate as if moving the foreign substance in the center line direction. Such disposition of the blade may effectively transfer the foreign substance moving to the sides of the guider 136 to the inside of the dust container 160 by the guider 136.

Figure 18A:
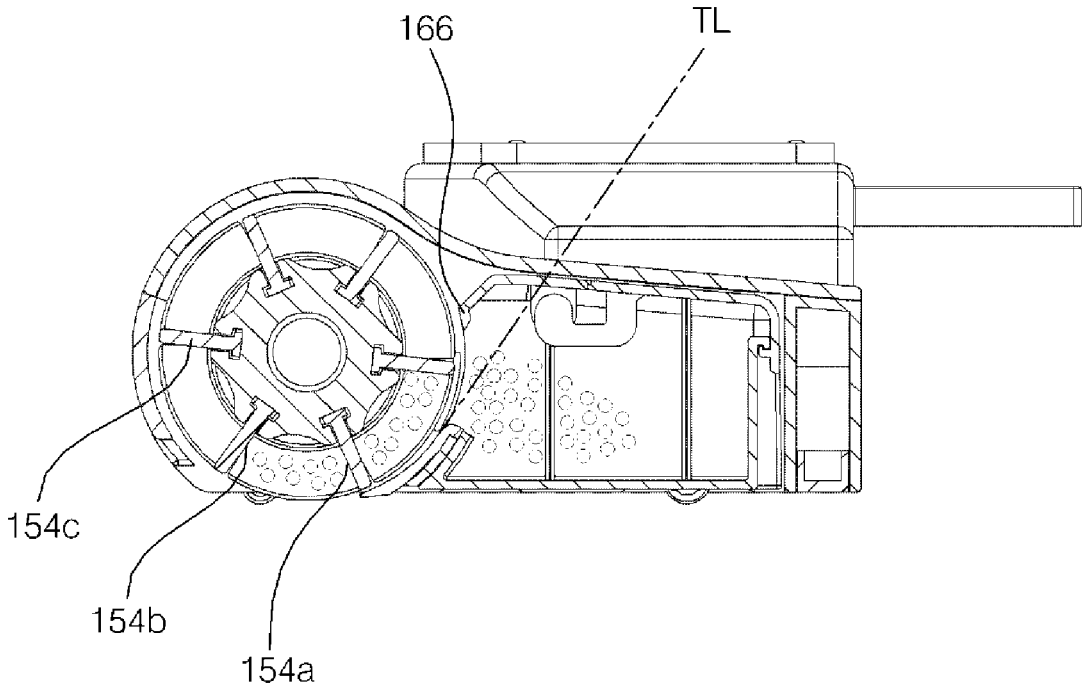
FIG. 18A is a sectional view taken along a line A-A' of FIG. 17A.
Figure 18B:
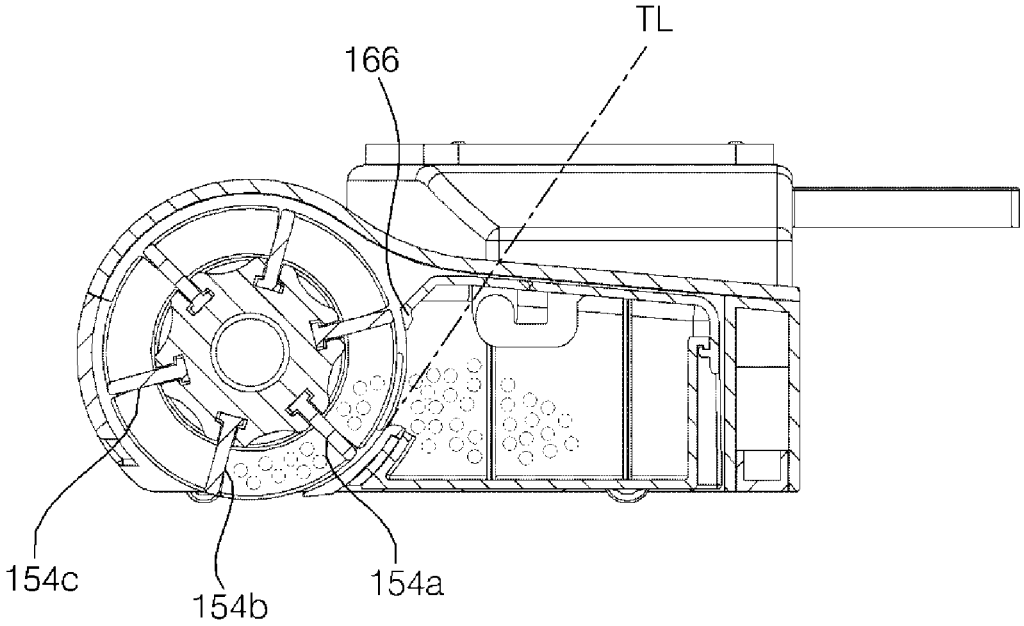
FIG. 18B is a sectional view taken along a line B-B' of FIG. 17B.
Figure 18C:
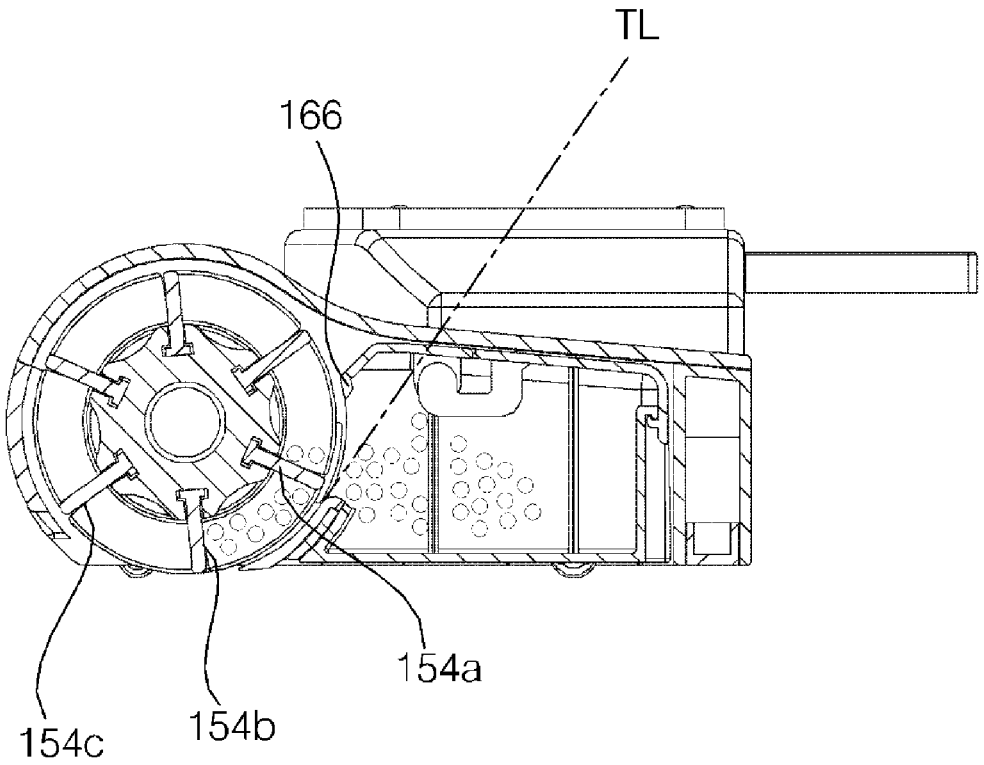
FIG. 18C is a sectional view taken along a line C-C' of FIG. 17C.

Referring to FIG. 18A to FIG. 18C, due to the operation of the driving motor 110, each of the blades 154*a*, 154*b* 154*c* of the agitator, which faces the floor surface being the cleaning target surface, may rotate to approach the dust container 160. Foreign substance on the cleaning target surface may move into the dust container 160 along the guide unit 108 due to the rotation of the blade 154*a*, 154*b*, 154*c*. For example, the rotation of the spiral blades 154*a*, 154*b* 154*c* may draw dust and other foreign substances away from the center, upwards, and rearward toward the opening 164 of the dust container 160.

Figure 19:
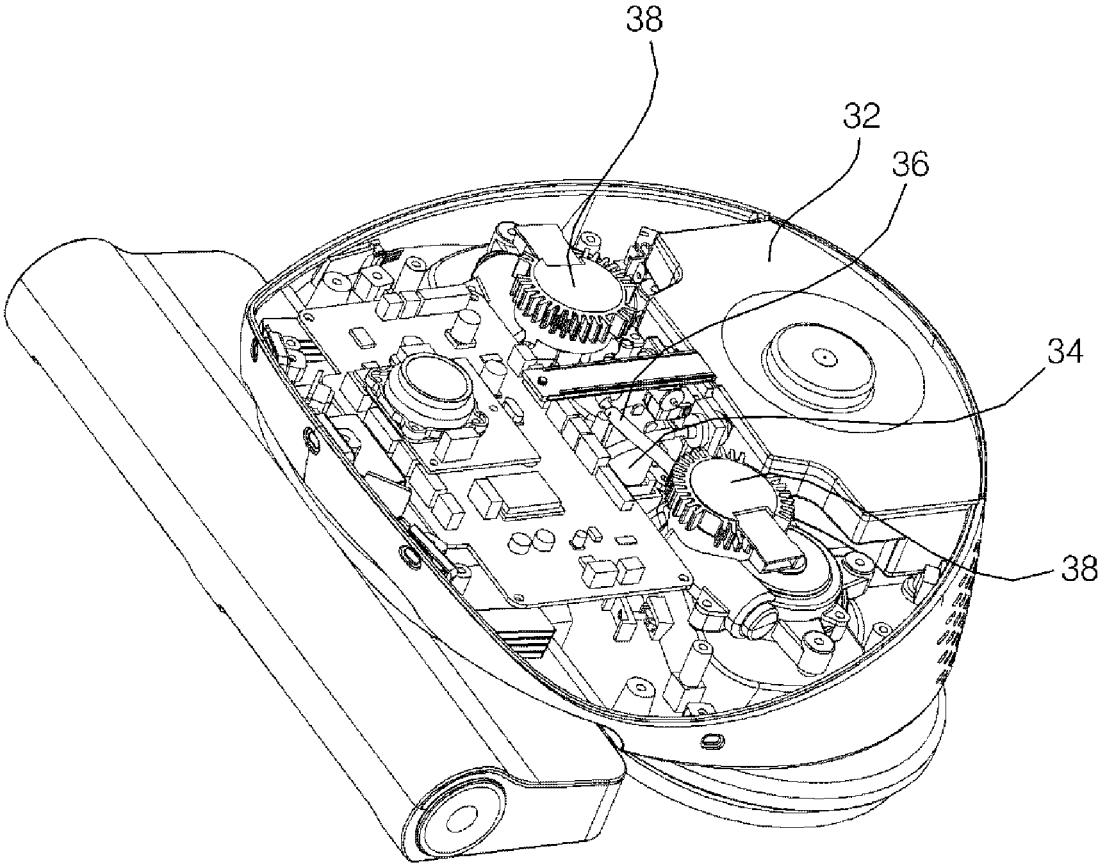
FIG. 19 is a view for explaining an internal configuration of a robot cleaner according to an embodiment of the present application.

FIG. 19 is a view for explaining an internal configuration of a robot cleaner 10 according to an embodiment of the present application. The moving mechanism of the present application may include two or more spin mops 30 capable of also mopping with a damp cloth or other mopping pad material. The robot cleaner 10 according to one embodiment may further include a water tank 32 which is positioned inside the main body 20 and stores water, a pump 34 which supplies the water stored in the water tank 32 to the spin mop 30, and a connecting hose 36 which connects the pump 34 and the water tank 32 or connects the pump 34 and the spin mop 30. The robot cleaner 10 according to one embodiment may also supply the water stored in the water tank 32 to the spin mop 30 by using a water supply valve (not shown) without a separate pump (e.g., without the pump 34), such as positioning the connecting hose 36 at downward direction between the water tank 32 and the spin mop 30 to cause water to flow due to gravity.

In the robot cleaner 10 according to one application, the cleaning module 100 is positioned in front of the pair of spin mops 30 to initially remove foreign substance on the floor surface, and then after the sweeping by the cleaning module 100, the spin mops 30 may mop the floor with a damp cloth or other mop pad, thereby cleaning the floor surface more thoroughly. Furthermore, by initially sweeping the floor to remove foreign substance such as dust that may damage the contact surface of the spin mops 30, the cleaning module may help extend the life of the spin mops 30 and reduce the amount of required maintenance.

According to the robot cleaner of the present application, one or more of the following aspects can be obtained. First, according to the robot cleaner of the present application, foreign substance on the cleaning target surface can be swept by the agitator, the dust container for accommodating the foreign substance is positioned to be detachable in a lower direction of the housing, and a fixing structure is formed in the housing to stably remove and discharge foreign substance. Second, according to the robot cleaner of the present application, the blade of the agitator is positioned spirally in the outer circumference of the rotation bar, so that the foreign substance can be collected more easily. Third, according to the robot cleaner of the present application, foreign substance on the cleaning target surface can be effectively removed by operating the agitator by using the driving motor.

The present application provides a robot cleaner which sweeps foreign substance positioned in a traveling direction of the robot cleaner. The present application further provides a robot cleaner which stably fixes a dust container that collects the swept foreign substance. The present application further provides a robot cleaner which drives an agitator by a driving motor to collect the foreign substance.

In accordance with an aspect of the present application, a robot cleaner may include: a main body which forms an external shape; two or more spin mops which rotate in a clockwise or counterclockwise direction when viewed from above and mop a floor with a damp cloth, and move the main body; and a cleaning module which is positioned in front of the pair of spin mops and collects foreign substance on a cleaning target surface, wherein the cleaning module includes: a housing which is coupled to the main body and opened at a lower side; a dust container which forms a space for accommodating foreign substance and is positioned to be detachable in a lower side direction of the housing; and an agitator which is positioned inside the housing, and sends foreign substance on the cleaning target surface to the dust container by a rotation operation, so that the agitator can send the foreign substance on the cleaning target surface to the dust container, and the dust container can be easily attached to and detached from the housing.

The housing may include: a fixing member which fixes the dust container to the inside of the housing; an elastic member which applies an elastic force to the fixing member; and a push button which releases the elastic force of the elastic member applied to the fixing member. A movement direction of the push button may be perpendicular to a movement direction of the fixing member, and the push button forms an inclined plane at a portion contacting the fixing member, so that the robot cleaner can be stably operated without pulling out the dust container to the lower side of the housing.

The dust container may include: a case which is opened in a part of a front surface, and inserted into the housing; and an upper cover which opens and closes an upper side of the case. A front portion of the case may have a shape corresponding to an outer circumference of the agitator and is partially opened, so that the foreign substance that moves due to the rotation of the agitator can be introduced into the dust container.

The agitator may include: a rotation bar which rotates based on a rotation shaft parallel to the cleaning target surface; and a plurality of blades which are positioned spirally in an outer circumferential surface of the rotation bar, so that the foreign substance on the cleaning target surface can be effectively removed.

The robot cleaner may further include a guider which guides the foreign substance approaching the cleaning module to the agitator, and the cleaning module may include two or more agitators which are positioned to be spaced apart at a certain interval on a same rotation axis, wherein the guider is positioned in a front side between the pair of the agitators, so that it is possible to send the foreign substance, which can escape to a space between the pair of agitators, to the agitator.

The robot cleaner may further include a driving motor which drives a rotation of the agitator. The cleaning module may include two or more agitators which are positioned to be spaced apart at a certain interval on a same rotation axis, so that the driving motor can be positioned between the pair of agitators so as to utilize a space of the housing, and to operate the two agitators by a single driving motor.

The robot cleaner may further include a transmission gear which transmits a rotational force of the driving motor to two or more agitators having a rotation axis perpendicular to a rotation axis of the driving motor, so that the rotational force can be transmitted in the vertical direction, and a space inside the housing can be utilized.

The housing may further include a guide member which partitions a space which accommodates the agitator and the dust container, wherein the guide member has a shape corresponding to an outer circumference of the agitator, so that the foreign substance can be guided to the dust container. A portion of the guide member may protrude to a lower side of a lower surface of the housing, so that the foreign substance that moves backward due to the rotation of the agitator can be moved into the dust container.

Hereinabove, although the present application has been described with reference to exemplary embodiments and the accompanying drawings, the present application is not limited thereto, but may be variously modified and altered by those skilled in the art to which the present application pertains without departing from the spirit and scope of the present application claimed in the following claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present application.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this application belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the application. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner comprising:

a main body;

a pair of spin mops coupled to the main body, each of the spin mops rotating in a clockwise or counterclockwise direction when viewed from above the robot cleaner and contacting a cleaning surface when rotating; and a cleaning head which is positioned in front of the spin mops and collects an object from the cleaning surface, wherein the cleaning head includes:

a housing which is coupled to the main body and includes a lower surface having an opening;

a pair of dust containers which includes an interior space to receive the object and is detachably coupled to the housing;

a pair of agitators which is positioned inside the housing, and rotates to collect the object through the opening and to send the object toward the pair of dust containers; and a guide extension coupled to the housing and that guides the object to the pair of agitators, and wherein the guide extension is positioned in front of and between the pair of agitators.

2. The robot cleaner of claim 1, wherein:

the pair of spin mops, the pair of dust containers, and the pair of agitators are arranged symmetrically with respect to a virtual center line dividing the main body in left and right directions, the pair of agitators are spaced apart from the virtual center line in the left and right directions, and the guide extension is disposed on the virtual center line.

3. The robot cleaner of claim 1, wherein the guide extension is disposed to be inclined with respect to a center line of the main body.

4. The robot cleaner of claim 1, wherein a width of the guide extension expands in a rearward direction.

5. The robot cleaner of claim 1, further comprising:

a driving motor which drives a rotation of the pair of agitators.

6. The robot cleaner of claim 5, wherein:

the pair of agitators is spaced apart by a certain interval, and the driving motor is positioned between a pair of the pair of agitators.

7. The robot cleaner of claim 5, further comprising a transmission gear which transmits a rotational force of the driving motor to the pair of the pair of agitators, rotation axis of the pair of agitators being perpendicular to a rotation axis of a drive shaft of the driving motor.

8. The robot cleaner of claim 1, wherein the pair of dust containers includes:

a case that has a front surface with an opening and is inserted into the housing; and an upper cover which moves to open and close an upper opening of the case.

9. The robot cleaner of claim 1, wherein the housing includes:

a fixing extension;

an elastic member which selectively applies an elastic force to the fixing extension, the elastic force causing the fixing extension to engage the pair of dust containers; and a push button which, when activated, releases the elastic force of the elastic member applied to the fixing member.

10. The robot cleaner of claim 1, wherein a portion of the front surface of the case has a shape corresponding to an outer circumference of the pair of agitators.

11. The robot cleaner of claim 1, wherein the pair of agitators includes:

a rotation bar which rotates on a rotation axis that extends parallel to the cleaning surface; and a plurality of blades which are positioned spirally in an outer circumferential surface of the rotation bar.

12. The robot cleaner of claim 1, further comprising a roller which separates a lower surface of the housing from the cleaning surface by a certain distance.

13. The robot cleaner of claim 12, wherein the roller is positioned on a lower surface of the pair of dust containers.

14. The robot cleaner of claim 1, wherein the housing further includes a guide wall which partitions an interior space in the housing which accommodates the pair of agitators and the pair of dust containers, and wherein a surface of the guide wall has a shape corresponding to an outer circumference of the pair of agitators.

15. The robot cleaner of claim 1, further comprising a water tank which stores water, and a connection channel through which the water flows from the water tank and to the spin mops.

* * * * *